US006837832B2

(12) United States Patent
Hanners et al.

(10) Patent No.: US 6,837,832 B2
(45) Date of Patent: Jan. 4, 2005

(54) ORTHOPEDIC SHOULDER WEIGHT HALTER

(76) Inventors: Ernest M. Hanners, 4640 Pacific Dr., West Frankfort, IL (US) 62896; Judy A. Hanners, 4640 Pacific Dr., West Frankfort, IL (US) 62896

( * ) Notice: Subject to any disclaimer, the term of this patent is extended or adjusted under 35 U.S.C. 154(b) by 416 days.

(21) Appl. No.: 10/112,453

(22) Filed: Apr. 1, 2002

(65) Prior Publication Data

US 2003/0186788 A1 Oct. 2, 2003

(51) Int. Cl.[7] ..... A63B 21/065
(52) U.S. Cl. ..... 482/105; D21/683
(58) Field of Search ..... 482/74, 93, 105; 2/94, 102; D21/680, 683

(56) References Cited

U.S. PATENT DOCUMENTS 4,382,302 A * 5/1983 Watson ..... 2/102
4,407,497 A * 10/1983 Gracie ..... 482/105
5,144,694 A * 9/1992 Conrad Da oud et al. ..... 2/69
5,167,600 A * 12/1992 Baird ..... 482/105
D342,108 S * 12/1993 Leibowitz ..... D21/683
5,916,070 A * 6/1999 Donohue ..... 482/74
6,081,924 A * 7/2000 Ott ..... 2/102
6,122,778 A * 9/2000 Cohen ..... 5/81.1 R
6,554,752 B2 * 4/2003 Cook ..... 482/105

* cited by examiner

*Primary Examiner*—Justine Yu
*Assistant Examiner*—Tam Nguyen
(74) *Attorney, Agent, or Firm*—Peter R. Bahn

(57) ABSTRACT

An orthopedic shoulder weight halter and corresponding weight(s) are described which allow one or more weights to be attached to shoulder straps by fastening material strips. Fourteen points of adjustment in the halter allow for a universe of different torso sizes. The harness possesses two shoulder straps, two front support straps, a waist strap, a chest strap, an upper back/chest strap, four double-D rings and two quick release buckles. The harness and the weight(s) can be easily put on or taken off of the wearer.

6 Claims, 5 Drawing Sheets

ORTHOPEDIC SHOULDER WEIGHT HALTER

BACKGROUND OF THE INVENTION

This invention fits into the general category of orthopedic devices and more particularly into the specific category of orthopedic body weight devices.

It is well known that persons with upper motor neuron problems, brain injury or illesses, spinal cord injury, multiple sclerosis, and other neurological dysfunctions often experience tremors of the body. It is also known that applying weight directly on the shoulders will reduce tremors and some involuntary spasticity associated with these and similar conditions that cause such tremors.

Up until now the standard attempt to satisfy this problem of applying orthopedic weights to the body have featured regular vest configurations with pockets sewn into the vest such that weights can then be inserted into the pockets. However, most weight pockets sewn into such vests are at the waist and/or chest areas rather than at the shoulder areas. Such configurations result in problems in that the weight being applied is pulling from a broad area and is displaced throughout the shoulder, back, neck, waist, and chest areas, rather than being focused mostly on the shoulder itself.

It is an object of this invention to correct such problems.

SUMMARY OF THE INVENTION

The orthopedic shoulder weight halter to be described here is widely adjustable to accommodate a variety of body sizes. Shoulder straps and front support straps are sewn to create loops that allow waist and chest straps to slide through them for positioning the shoulder straps and front support straps to maintain a proper alignment. The shoulder straps are easily adjustable in length by use of double-D rings which are located on the front support straps, and through which the shoulder straps are threaded. Quick release buckles with double-D rings offer easy width adjustments to the waist and chest straps, and also allow the halter to be donned or taken off quickly.

Loop side fastening material strips, such as loop side Velcro, that are sewn to the shoulder straps hold weights on and allow the weights to be centered, or off-centered, as desired by the user or health care practitioner.

An adjustable butterfly strap containing a hook side fastening material strip, such as hook side Velcro, is attached to the back section of both shoulder straps. The butterfly strap attaches tightly to the loop side fastening strips sewn onto the shoulder straps. The butterfly strap adjusts the width of the shoulder straps and holds the shoulder straps in place to prevent the weight(s) from sliding off the shoulder. Various other means can be used to accomplish the same effect as the butterfly strap. A simple strip of hook side fastening material or a strip of hook side fastening material sewn onto a simple strap will accomplish the same end.

A hook side fastening material strip is sewn on one side of the weight(s) used in this invention, and a loop side fastening material strip is sewn onto the other side of the same weight(s). This allows the weight(s) to be attached to the other shoulder strap(s), and also allows the weights to be stacked one on top of the other. This stacking method is used to increase the amount of weight as needed. The weights are preferably made of a nylon covered neoprene material, but may also be made with most fabrics. With this invention, the weight is being applied directly to the shoulder area, giving maximum benefit.

BRIEF DESCRIPTION OF THE DRAWINGS

Different views of the invention are shown in the accompanying drawings.

DESCRIPTION OF THE INVENTION

Figure 1:
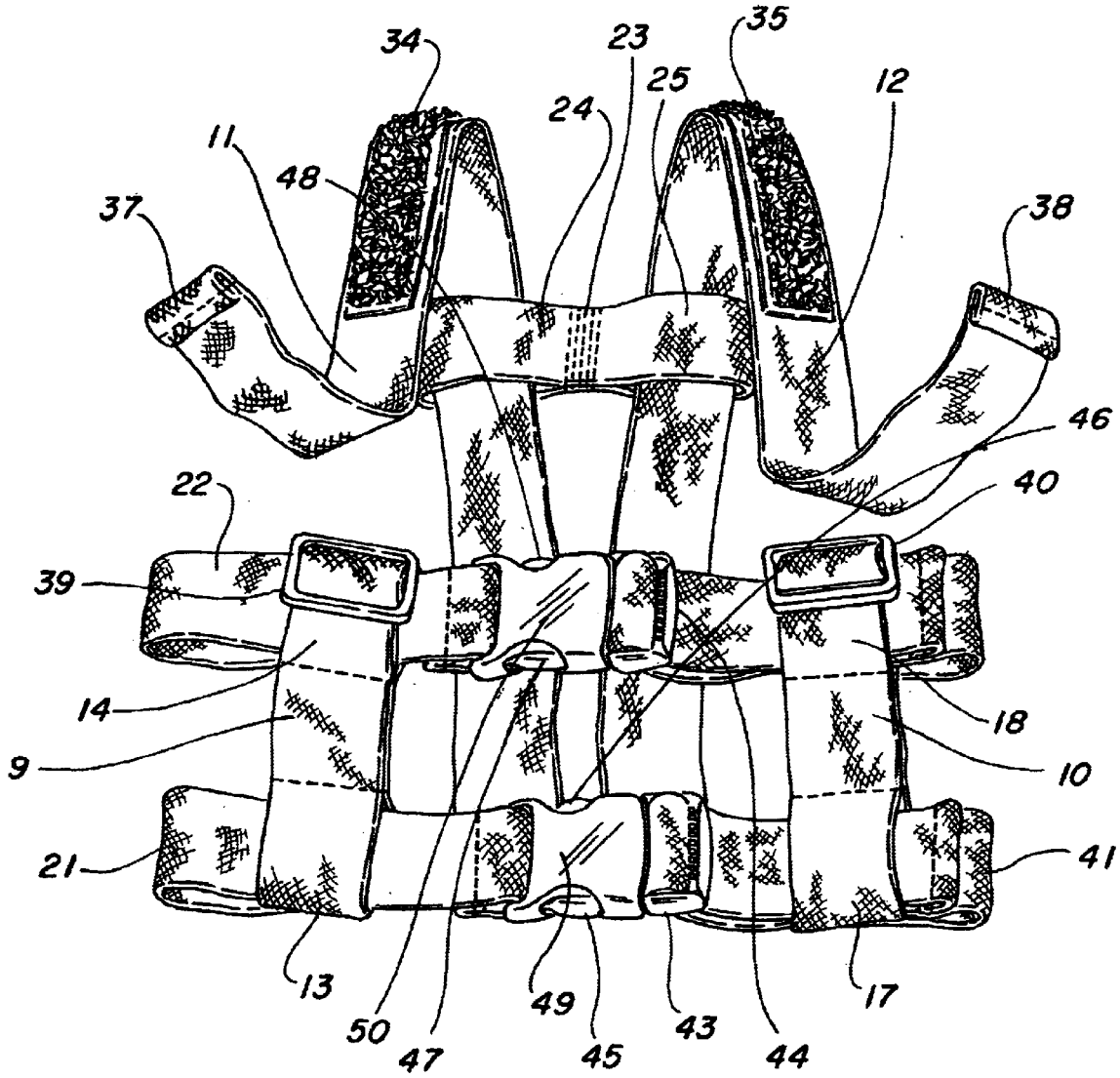
FIG. 1 shows a front view of the orthopedic shoulder weight halter with shoulder straps disconnected from front support straps.
Figure 2:
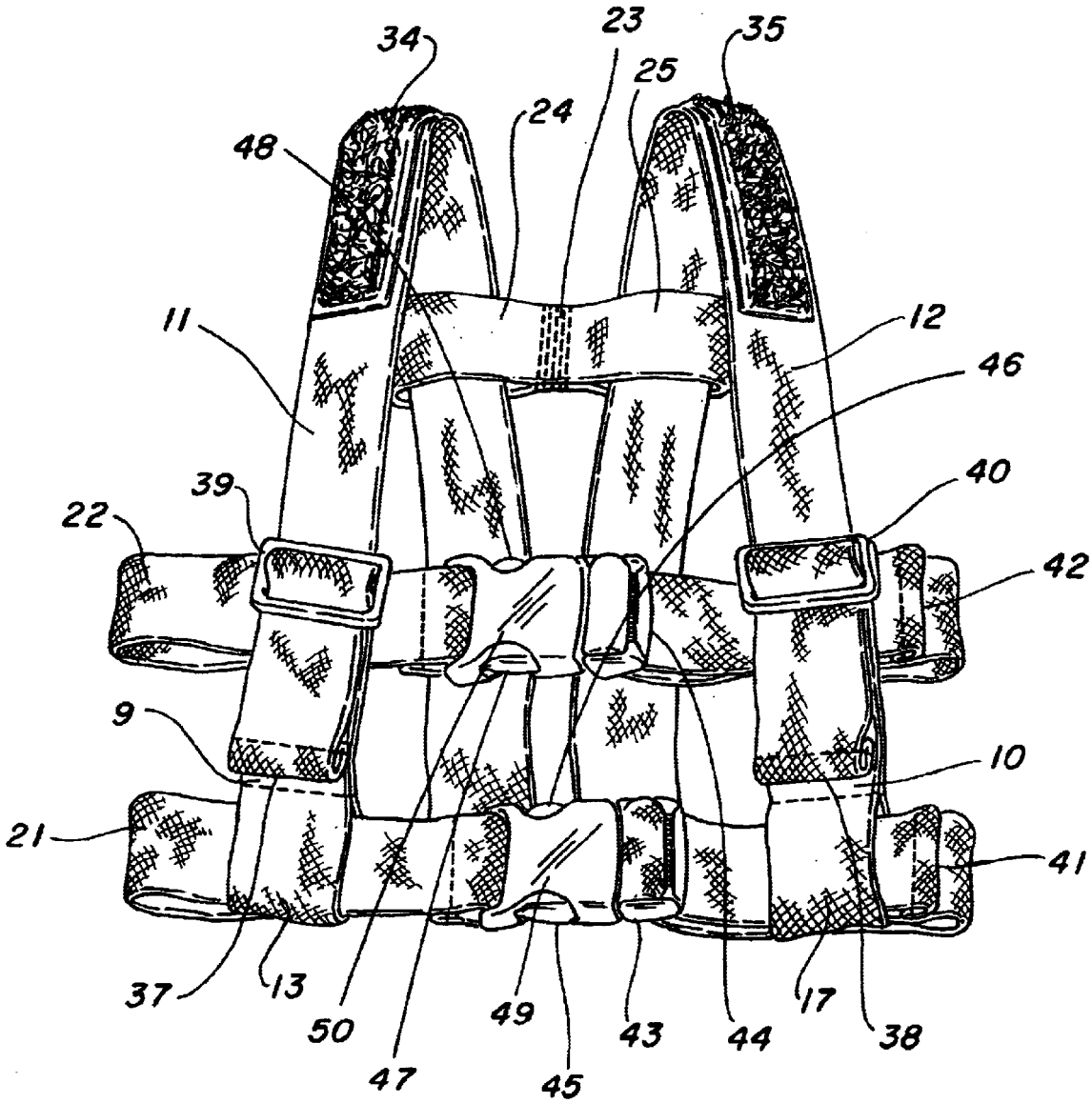
FIG. 2 shows a front view of the orthopedic shoulder weight halter with shoulder straps attached to front support straps.
Figure 3:
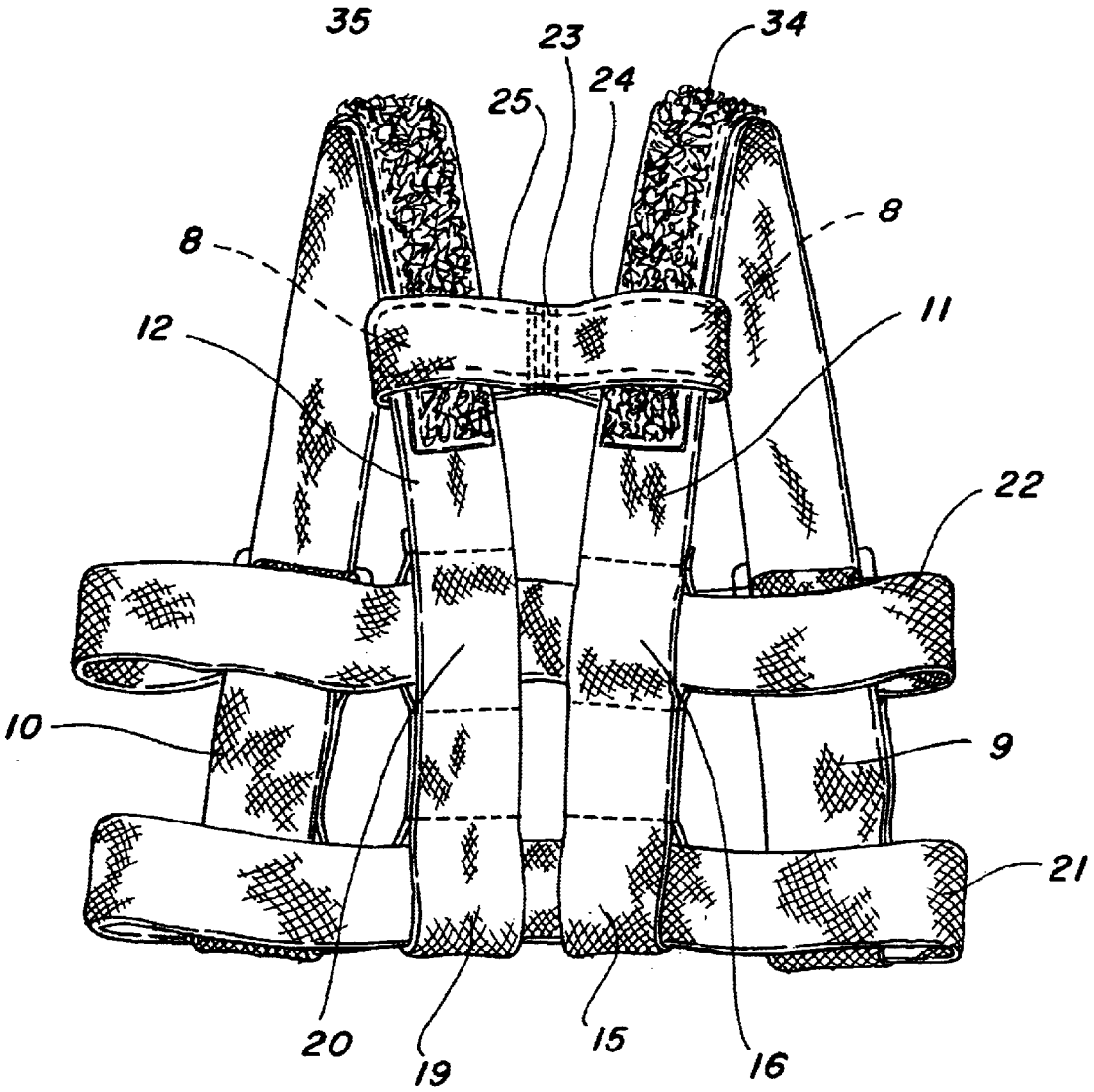
FIG. 3 shows a back view of the halter.
Figure 4:
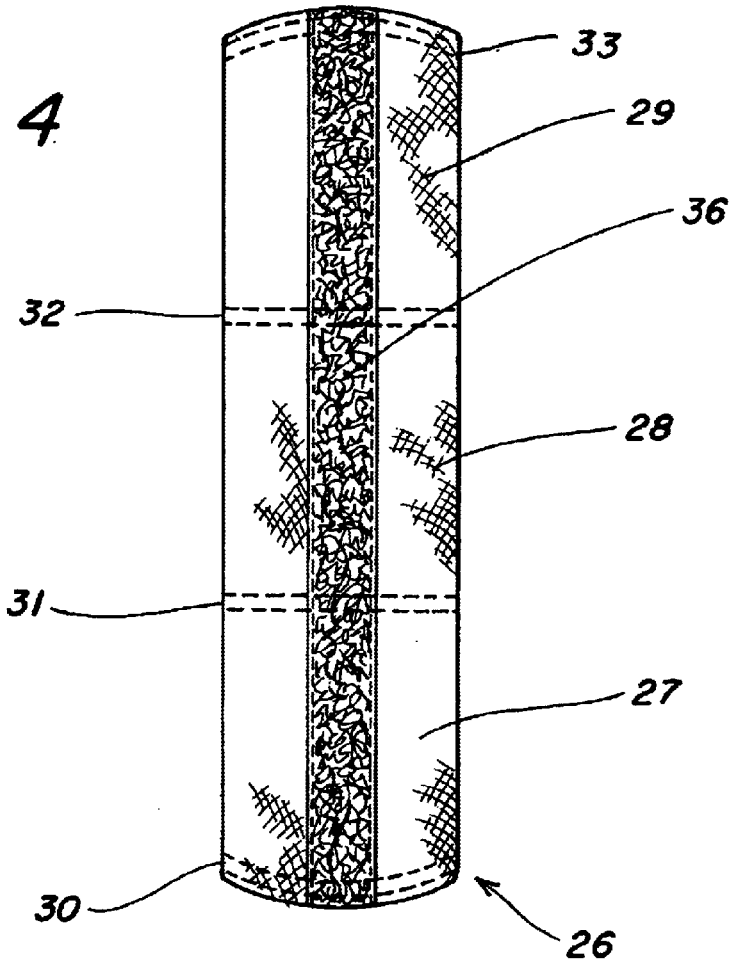
FIG. 4 shows a top view of one of the weights for the halter.
Figure 5:
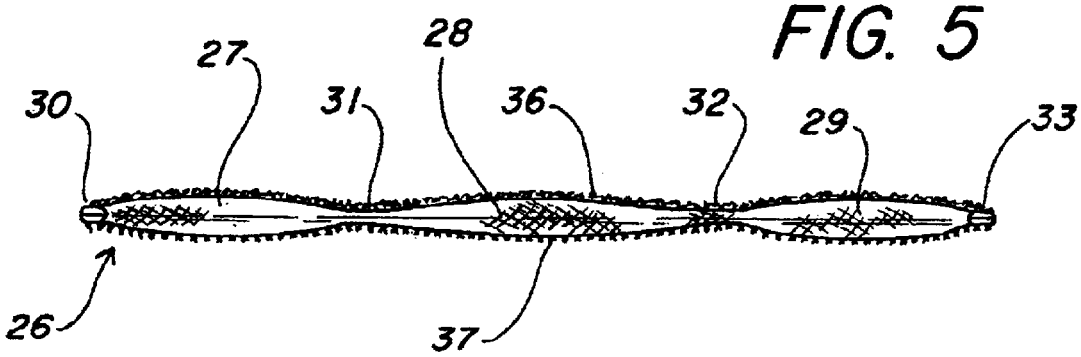
FIG. 5 shows a side view of one of the weights for the halter.
Figure 6:
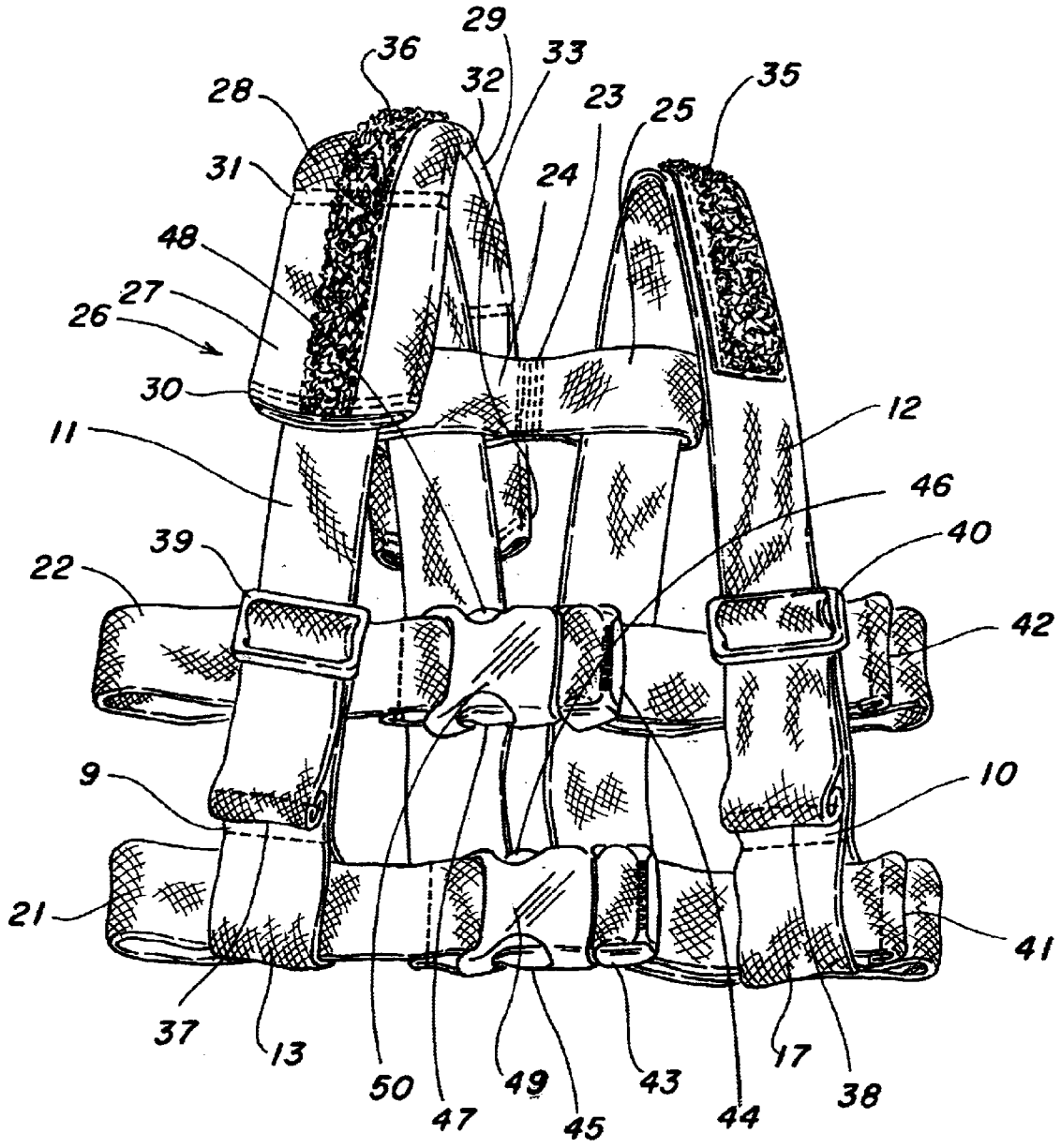
FIG. 6 shows a front view of the halter with one of the weights attached to a shoulder strap of the halter.

Looking at FIGS. 1 through 6 simultaneously, it is seen that the orthopedic shoulder weight halter is essentially comprised of a right shoulder strap 11, left shoulder strap 12, a waist strap 21, a chest strap 22, a right support strap 9, a left support strap 10, and a weight 26 that attaches to one of the shoulder straps. The lengths of the shoulder straps 11 and 12 are adjustable by being threaded through the double-D rings 39 and 40 sewn into the front support straps 9 and 10, the overlapping respective ends 37 and 38 of the straps allowing plenty of extra strap length for suitable adjustment of strap length.

Sewn into right support strap 9 are front loops 13 and 14. Similarly, sewn into left shoulder strap 10 are front loops 17 and 18. Sewn into right shoulder strap 11 are back loops 15 and 16. Similarly, sewn into left shoulder strap 12 are back loops 19 and 20.

Through the support strap bottom loops 13 and 17, and through the shoulder strap bottom back loops 15 and 19, passes an adjustable waist strap 21. Through the support strap upper front loops 14 and 18, and through the shoulder strap upper back loops 16 and 20, passes an adjustable chest strap 22. Waist strap 21 is adjustable in length by virtue of a double-D ring 43 with buckle inserts 45 and 46, which inserts lock into a quick release buckle clasp 49. Chest strap 22 is ajustable by virtue of a double-D ring 44 with buckle inserts 47 and 48, which inserts lock into a quick release buckle clasp 50. The overlapping waist strap and chest strap ends 41 and 42 provide for easy adjustability over a wide range of waist and chest sizes.

A butterfly strap 23 with a right loop 24, a left loop 25, and a hook side fastening material strip 8 sewn into it, provides positional stability to the upper part of the shoulder straps 11 and 12 about the torso when weights attached to shoulder straps might tend to pull the shoulder straps off of the wearer's shoulders. Although the butterfly strap 23 is shown in the Figures as being in the back of the halter over the wearer's shoulder blades, the butterfly strap 23 could also be positioned in the front of the wearer's upper chest, depending on where positional stability of the halter about the wearer's torso is greatest.

On top of right shoulder strap 11 is sewn a strip of loop side fastening material 34 and on top of left shoulder strap 12 is sewn a strip of loop side fastening material 35. These two strips of loop side fastening material 34 and 35 stick to the hook side fastening material strip 8 sewn inside the butterfly strap 23. which keeps the butterfly strap in a stable location against the upper back or upper chest of the harness wearer. A simple strip of hook side fastening material or a strip of hook side fastening material sewn onto a strap could have been used to accomplish the same purpose as the butterfly strap 23.

The weight 26 which accompanys this orthopedic shoulder weight halter is made from a cylindrical tube of nylon covered neoprene material which has been sewn with four seams located at positions 30, 31, 32, and 33, which flattens the tube into a triply compartmented flexible bag. Seam positions will vary with different weight sizes. The bag sections of the weight are filled with pellet weights.

On top of the weight is sewn a hook side fastening material strip 36 and on the bottom of the weight is sewn a loop side fastening material strip 37. This feature of the weights allows several weights to be stacked on top of each other if more than the weight of a single weight is desired.

To use this othropedic shoulder weight halter and corresponding weight(s), the wearer first puts the halter on his or her torso, and buckles the waist and chest straps, and then adjusts the shoulders, waist, chest, and butterfly straps for a comfortable but snug fit. Then the weight(s) are applied to one or the other, or both shoulders straps, applying the hook side fastening material strips of the weights to the loop side fastening material strips of the shoulder straps. One of the advantages of this shoulder weight halter in comparison with any prior art is that this halter has fourteen different adjustment points, namely the loops 13, 14, 15, 16, 17, 18, 19, 20, 24, 25, and the double-D rings 39, 40, 43, and 44, that allow for an infinite number of fits to different human torsos sizes.

What is claimed is:

1. An orthopedic shoulder weight halter comprising two shoulder straps containing loops and which are connectable to two front support straps containing loops through which pass a waist strap and a chest strap, the two shoulder straps being braced by an upper back/chest strap, the two shoulder straps each containing a fastening material strip, and at least one corresponding weight also containing at least one fastening material strip, which allows the weights to be attached to the shoulder straps of the said halter.

2. The orthopedic shoulder weight halter and corresponding weights described in claim 1 wherein the said front support straps, waist strap, and chest strap contain double-D rings which allow lengths of the chest, waist, and shoulder straps to be adjustable, and wherein the said upper back/chest strap is an adjustably positioning strap, and wherein the said weights are comprised of weight-filled fabric bags with loop side fastening material strips and hook side fastening material strips on opposite sides of the bags for possible stacking of the weights.

3. The orthopedic shoulder weight halter and corresponding weights described in claim 2 wherein the said waist strap and chest strap contain buckles, and the said upper back/chest strap is a butterfly strap containing a fastening material strip, and the said straps are comprised of nylon, and the said fabric containing the weights is a nylon covered neoprene material.

4. The orthopedic shoulder weight halter and corresponding weights described in claim 1 wherein the said halter possesses fourteen different points of adjustment: two front support strap-waist strap intersections, two back shoulder strap-waist strap intersections, two front support strap-chest strap intersections, two back shoulder strap-chest strap intersections, two shoulder strap-upper back/chest strap intersections, one waist strap double-D ring interaction, one chest strap double-D ring interaction, and two shoulder strap-to-front support strap double-D ring connections.

5. The orthopedic shoulder weight halter and corresponding weights described in claim 2 wherein the said halter possesses fourteen different points of adjustment: two front support strap-waist strap intersections, two back shoulder strap-waist strap intersections, two front support strap-chest strap intersections, two back shoulder strap-chest strap intersections, two shoulder strap-upper back/chest strap intersections, one waist strap double-D ring interaction, one chest strap double-D ring interaction, and two shoulder strap-to-front support strap double-D ring connections.

6. The orthopedic shoulder weight halter and corresponding weights described in claim 3 wherein the said halter possesses fourteen different points of adjustment: two front support strap-waist strap intersections, two back shoulder strap-waist strap intersections, two front support strap-chest strap intersections, two back shoulder strap-chest strap intersections, two shoulder strap-upper back/chest strap intersections, one waist strap double-D ring interaction, one chest strap double-D ring interaction, and two shoulder strap-to-front support strap double-D ring connections.

* * * * *